US008248432B2

(12) United States Patent
Lee et al.

(10) Patent No.: US 8,248,432 B2
(45) Date of Patent: Aug. 21, 2012

(54) DISPLAY APPARATUS AND METHOD OF IMAGE ENHANCEMENT THEREOF

(75) Inventors: Sang-hoon Lee, Suwon-si (KR); Young-jun Ryu, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 783 days.

(21) Appl. No.: 12/124,569

(22) Filed: May 21, 2008

(65) Prior Publication Data

US 2009/0109234 A1 Apr. 30, 2009

(30) Foreign Application Priority Data

Oct. 25, 2007 (KR) ..... 10-2007-0107825

(51) Int. Cl.
*G09G 5/02* (2006.01)

(52) U.S. Cl. ..... 345/591; 345/589; 345/604; 345/690; 382/167; 382/168; 382/171; 382/172

(58) Field of Classification Search ..... None
See application file for complete search history.

(56) References Cited

U.S. PATENT DOCUMENTS 6,018,588 A * 1/2000 Kim ..... 382/167
6,018,589 A * 1/2000 Hyodo ..... 382/168
6,664,973 B1 * 12/2003 Iwamoto et al. ..... 345/589

* cited by examiner

*Primary Examiner* — Antonio A Caschera
(74) *Attorney, Agent, or Firm* — Sughrue Mion, PLLC

(57) ABSTRACT

A method of image enhancement includes acquiring color information from an image, determining a color distribution of the image based on the color information, and changing a brightness of the image based on the color distribution.

25 Claims, 3 Drawing Sheets

DISPLAY APPARATUS AND METHOD OF IMAGE ENHANCEMENT THEREOF

CROSS-REFERENCE TO RELATED APPLICATIONS

This application claims priority from Korean Patent Application No. 10-2007-0107825, filed Oct. 25, 2007 in the Korean Intellectual Property Office, the entire disclosure of which is hereby incorporated by reference.

BACKGROUND OF THE INVENTION

1. Field of the Invention

Apparatuses and methods consistent with the present invention relate to image display and enhancement, and more particularly, to a display device and an image enhancement method thereof which improves a quality of an image represented based on a received signal.

2. Description of the Related Art

Display devices such as liquid crystal displays (LCDs) are implemented in devices such as televisions (TVs), laptop computers, or desktop computers to display images.

A display device has a limited color gamut, that is, a limited range of representing YCbCr color signals in a color space. A brightness signal Y has a color gamut limited to the range of 16~235, and an color aberration signal CbCr has a color gamut limited to the range of 16~240.

This limit of color gamut has been extended in the recent display devices. A display device, which supports an extend-gamut, can display an xvYCC signal which represents almost the entire range of color gamut from 0 to 255, except for $0\sim2^{n-8}1$ and $254*2^{n-8}+1\sim2^{N}-1$. However, a negative RGB color value, or a red green blue (RGB) color value exceeding 255 is sometimes generated in the process of converting an xvYCC signal into a RGB color value to display.

A related art display device generally employs clipping in which negative RGB color values are processed as zeros, and RGB color values above 255 are processed as 255. Such clipping process changes the brightness and chromaticity of a received image signal, and accordingly alters the original color and brightness. Therefore, an image quality deteriorates.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present invention provides a display device and an image enhancement method thereof, which improves a quality of an image represented based on a received image signal, by changing a color space and also acquiring color information and accordingly changing the brightness of the received image signal.

According to an aspect of the present invention, there is provided a method of image enhancement, including acquiring color information from a received image, computing a color distribution of the received image based on the color information, and changing a brightness of the received image based on the computed color distribution.

According to another aspect of the present invention, the computing includes converting a number of pixels regarding the color information into a histogram and computing the color distribution.

According to another aspect of the present invention, the changing includes determining a brightness changing rate of the received image according to chromaticity, and changing the brightness of the received image based on the determined brightness changing rate.

According to another aspect of the present invention, the acquiring includes acquiring the color information by a color space conversion of the received image, and the changing includes generating a reverse-accumulative histogram based on the acquired color information changing the brightness of the received image based on the color distribution computed through the reverse-accumulative histogram.

According to another aspect of the present invention, the color space includes one of a YCbCr space, an RGB space, a uniform color space such as CIE xy or CIE Luv, and a Hue Saturation Value (HSV) color space.

According to another aspect of the present invention, the changing includes changing the brightness of the image with respect to each of color regions constituting the converted color space.

According to another aspect of the present invention, the changing includes changing the brightness of the image based on a total number of pixels of the color regions and a preset reference.

According to another aspect of the present invention, the computing includes converting a number of pixels of each of the color regions into a histogram, and converting the histogram into a reverse-accumulative histogram to compute the color distribution of the received image, and the changing includes changing the brightness of the received image regarding each of the color regions, based on the computed color distribution.

According to another aspect of the present invention, the changing includes computing a number of pixels that correspond to a predetermined reference among the entire pixels included in the color regions, searching a color value that corresponds to the computed number of pixels, based on the color distribution of the received image, and computing a brightness compression rate to change the brightness of the received image, the brightness compression rate being rate between the searched color value and a maximum displayable color value.

According to another aspect of the present invention, the changing includes changing the brightness of the received image by multiplying the computed brightness compression rate by each of the pixels included in the color regions.

According to another aspect of the present invention, the color information includes at least one of hue, saturation, and value of the received image.

According to another aspect of the present invention, the received image has an extended region from a displayable brightness region.

According to another aspect of the present invention, a display apparatus is provided including: a computing unit which acquires color information from a received image, and computes a brightness changing rate of the received image based on the color information, and a brightness adjusting unit which adjusts a brightness of the received image based on the computed brightness changing rate.

According to another aspect of the present invention, the computing unit converts a number of pixels regarding the color information into a histogram and computes the brightness changing rate.

According to another aspect of the present invention, the computing unit computes the brightness changing rate of the received image according to chromaticity, and the brightness adjusting unit adjusts the brightness of the received image based on the determined brightness changing rate.

According to another aspect of the present invention, the computing unit acquires the color information by a color space conversion of the received image, and computes the brightness changing rate of the received image, and the brightness adjusting unit changes the brightness of the received image based on the acquired brightness changing rate.

According to another aspect of the present invention, the color space includes one of a YCbCr space, an RGB space, a uniform color space such as CIE xy or CIE Luv, and an HSV color space.

According to another aspect of the present invention, the computing unit computes the brightness changing rate of each of color regions defined by the hue in the color space, and the brightness adjusting unit adjusts the brightness of each of the color regions of the received image, by applying the computed brightness changing rates to each of the color regions.

According to another aspect of the present invention, the computing unit computes a reference pixel value based on a total number of pixels included in each of the color regions of the converted color space, and the brightness changing rate to represent a relation between a reference brightness value that corresponds to the reference pixel value and a maximum displayable color gamut, and the brightness adjusting unit adjusts the brightness of the received image by multiplying the brightness value of the image distributed in each of the color regions by the brightness changing rate of each of the color regions.

According to another aspect of the present invention, the received image has an extended region from a displayable brightness region.

According to another aspect of the present invention, a method of image enhancement is provided, including acquiring color information from a received image, computing a brightness changing rate of the received image based on the color information, and changing the brightness of the received image only, based on the computed brightness changing rate.

According to another aspect of the present invention, the acquiring includes acquiring the color information through a color space conversion of the received image, and the computing includes converting a number of pixels of the color information into a histogram and computing the brightness changing rate of the brightness changing rate.

According to another aspect of the present invention, the computing includes computing the brightness changing rate of each of color regions defined by chromaticity, and the changing includes changing the brightness of each of the color regions of the received image based on the brightness changing rate of each of the color regions.

According to another aspect of the present invention, the computing includes computing the brightness changing rate of each of the color regions based on a total number of pixels included in each of the color regions of the converted color space, and the brightness changing rate to represent a relation between a reference brightness value that corresponds to the reference pixel value and a maximum displayable color gamut, and the changing includes changing the brightness of each of the color regions of the received image by multiplying the brightness value of the image distributed in each of the color regions by the brightness changing rate of each of the color regions.

According to another aspect of the present invention, the color space includes one of a YCbCr space, an RGB space, a uniform color space such as CIE xy or CIE Luv, and an HSV color space.

BRIEF DESCRIPTION OF THE DRAWINGS

The above and other aspects of the present invention will become apparent and more readily appreciated from the following description of the exemplary embodiments, taken in conjunction with the accompany drawings of which.

DETAILED DESCRIPTION OF EXEMPLARY EMBODIMENTS THE INVENTION

Figure 1:
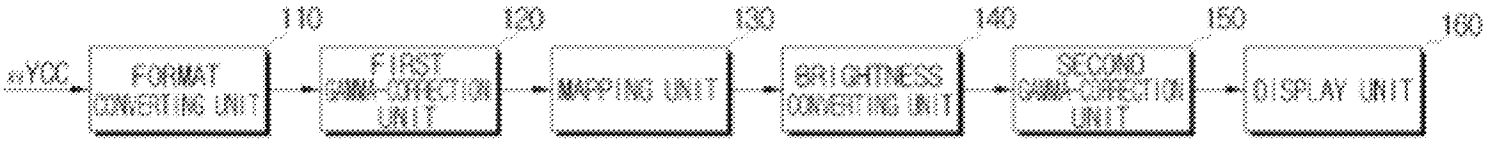
FIG. 1 is a block diagram of a display device according to an exemplary embodiment of the present invention.

Certain exemplary embodiments of the present invention will be described in greater detail with reference to the accompanying drawings.

In the following description, same drawing reference numerals are used for the same elements even in different drawings. The exemplary embodiments defined in the description, such as detailed construction and elements, are provided to assist in a comprehensive understanding of the invention. However, the present invention can be carried out without those specifically defined matters. Also, well-known functions or constructions are not described in detail since they would obscure the invention with unnecessary detail.

FIG. 1 is a block diagram of a display device according to an exemplary embodiment of the present invention.

Referring to FIG. 1, the display device includes a format converting unit 110, a first gamma correction unit 120, a mapping unit 130, a brightness changing unit 140, a second gamma correction unit 150, and a display unit 160.

The format converting unit 110 converts a format of a received image into an RGB format. Specifically, if a received image includes an xvYCC color gamut, or a standard YCC (sYCC) color gamut, the format converting unit 110 converts the received image into an RGB format and outputs the resultant image. The format converting unit 110 may also convert an image such as a YCbCr image, which is other than the images having an extend-color gamut, into an RGB format.

The first gamma correction unit 120 performs gamma correction of the non-linear RGB data converted at the format converting unit 110, and outputs the resultant linear RGB data.

The mapping unit 130 maps the color gamut of an image so that the optimum chromaticity is obtained when the image, gamma corrected by the first gamma correction unit 120, is reproduced. In other words, the mapping unit 130 maps the color gamut of the linear RGB data corrected at the first gamma correction unit 120 and outputs the result so that the linear RGB data is reproduced through the display unit 160 with the optimum chromaticity.

The brightness converting unit 140 generates a histogram using the brightness of the mapped image, and computes a brightness compression rate of the image based on the generated histogram. The brightness converting unit 140 adjusts the brightness of the image accordingly. The brightness converting unit 140 will be explained in detail with reference to FIG. 2.

The second gamma correction unit 150 performs gamma correction of an brightness-adjusted image received from the brightness converting unit 140, and outputs the corrected image to the display unit 160. Herein, the manner of conducting gamma correction will not be explained in detail, since this is generally known in the field of display.

The display unit 160 outputs the gamma corrected image from the second gamma correction unit 150. Specifically, the display unit 160 outputs an image after the brightness of the image is adjusted at the brightness converting unit 140 and the image is gamma corrected at the second gamma correction unit 150.

The display device according to the exemplary embodiments of the present invention has been explained so far. While the display device is explained as including the mapping unit 130 therein to map the gamma corrected image data, the present invention is not limited thereto, and the mapping unit 130 may be omitted from the display device.

Figure 2:
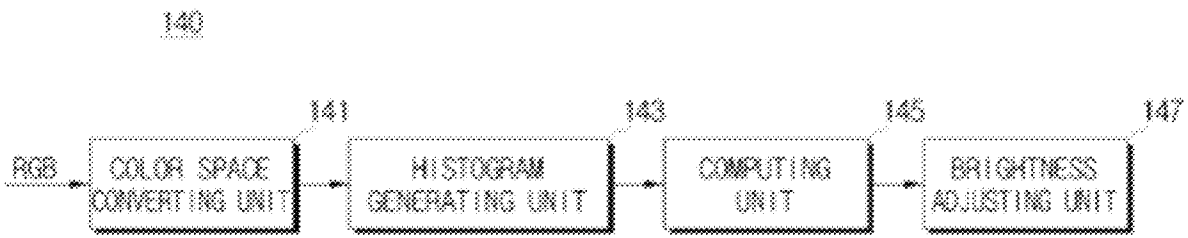
FIG. 2 is a block diagram of a brightness changing unit employed in a display device according to an exemplary embodiment of the present invention.

FIG. 2 is a block diagram of a brightness converting unit employed in a display device according to an exemplary embodiment of the present invention.

Referring to FIG. 2, the brightness converting unit 140 includes a color space converting unit 141, a histogram generating unit 143, a computing unit 145, and a brightness adjusting unit 147.

The color space converting unit 141 converts an RGB image received from the mapping unit 130 to correspond to the HSV color space coordinates.

Figure 3:
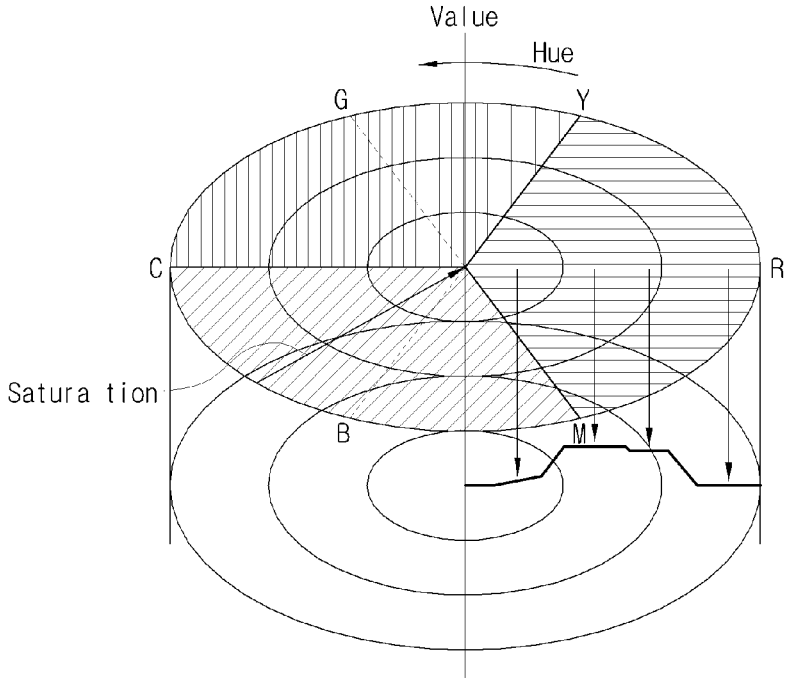
FIG. 3 illustrates an RGB format image in the HSV color space coordinate system, in a display device according to an exemplary embodiment of the present invention.

Referring to FIG. 3, the color space converting unit 141 converts a received RGB image to adapt the image to the HSV color space coordinates. Specifically, the color space converting unit 141 converts the color information of the RGB format image from the mapping unit 130 into HSV color information so that the RGB format image is located in the HSV color space coordinates. The HSV color space will not be explained in detail, since this is generally known in the related field.

Referring to FIG. 3, the HSV color space coordinates generally includes six color regions such as a red (R) region, a yellow (Y) region, a green (G) region, a cyan (c) region, a blue (B) region, and a magenta (M) region. In the description of the exemplary embodiment of the present invention set forth below, only the three color regions, that is, the R, G and B regions will be explained for convenience of explanation. Furthermore, the HSV color space coordinates may have more than six color regions.

The histogram generating unit 143 generates a histogram based on the HSV color information converted at the color space converting unit 141. The histogram generating unit 143 generates a histogram based on each of the R, G and B color regions.

Figure 4:
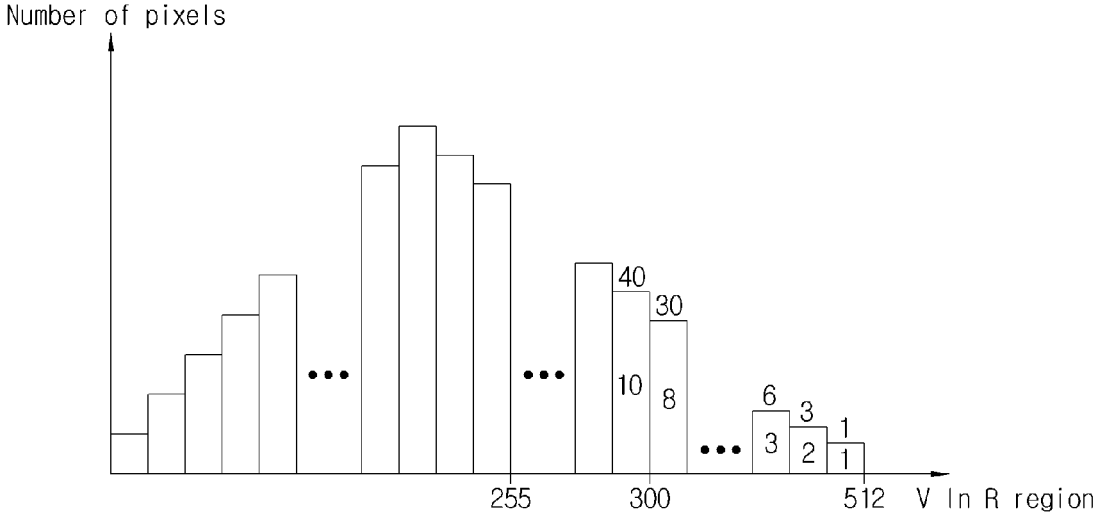
FIG. 4 illustrates an example of a histogram generated by using a V in an R region in the HSV color space coordinate system of FIG. 3.

The histogram generating unit 143 generates a histogram based on an accumulative value of the number of pixels that corresponds to V of the HSV color space coordinates. Referring to FIG. 4, the histogram generating unit 143 generates a histogram of the R region based on the distribution of the V in the R region, that is, based on the accumulation of the number of pixels that include the same V.

The histogram generating unit 143 also generates a reverse-accumulative histogram for each of the R, G and B color regions, based on the generated histogram. Referring to FIG. 4, the histogram generating unit 143 generates a reverse-accumulative histogram of R region based on the accumulation of the number of pixels that corresponds to the V from 0 to 512, or V from 512 to 0 of the entire pixels.

The computing unit 145 computes a brightness compression rate of each of the color bands of the HSV color space, using the histogram generated by the histogram generating unit 143 and a predetermined reference. The predetermined reference may be implemented as a ratio, which is preset according to the color range of an image to express through the display unit 160.

The computing unit 145 converts the R region's histogram into a reverse-accumulative histogram, computes a reference pixel value of the R region to represent the number of pixels that correspond to the predetermined reference among the entire pixels distributed in the R region, and determines the V that corresponds to the computed reference pixel value to be the reference brightness of the R band. Referring to FIG. 4, if the reference is set to 5% and the number of entire pixels are 600, the computing unit 145 obtains 30 (600*0.05) of the reference pixel value, and determines V=300 to be the reference brightness value to correspond to the reference pixel value 30 of the R region. The reference pixel value 30 obtained by the computing unit 145 represents the number of pixels of the reverse-accumulative histogram.

The computing unit 145 also computes a brightness compression rate by dividing the maximum value 255 of the displayable color gamut by the reference brightness value of the R band, that is, 255/300=0.85. The computing unit 145 computes the brightness compression rates of the remaining color regions of the HSV color space, which are the G and B regions, in the same manner of obtaining the brightness compression rate of the R band.

The brightness adjusting unit 147 adjusts the brightness of an image by multiplying the brightness compression rates obtained at the computing unit 145 by each of the corresponding color regions. Accordingly, the brightness adjusting unit 147 adjusts the brightness of the pixels distributed in the R region, by multiplying the brightness compression rate (255/300) by the brightness of the pixels distributed in the R region. The brightness adjusting unit 147 adjusts the brightness of the G and B regions in the same manner, by multiplying the brightness of the pixels distributed in the G and B regions by the brightness compression rates of the G and B regions.

The brightness adjusting unit 147 also adjusts the brightness value of the color regions by clipping, if the color regions contain brightness values exceeding the reference brightness values. Referring to FIG. 4, the brightness adjusting unit 147 adjusts the V ranging from 301 to 512 of the R region that exceed 300 as the reference V based on 255, which is the maximum V displayable. The brightness adjusting unit 147 may adjust the brightness compression rate and the brightness of the pixels using interpolating, if the brightness value exists in a boundary between the respective color regions.

In a display device according to an exemplary embodiment of the present invention, the mapping unit 130 may be omitted. In this case, the brightness converting unit 140 may receive an input of gamma-corrected RGB image and computes a brightness compression rate of the received image to change the brightness of the image.

Figure 6:
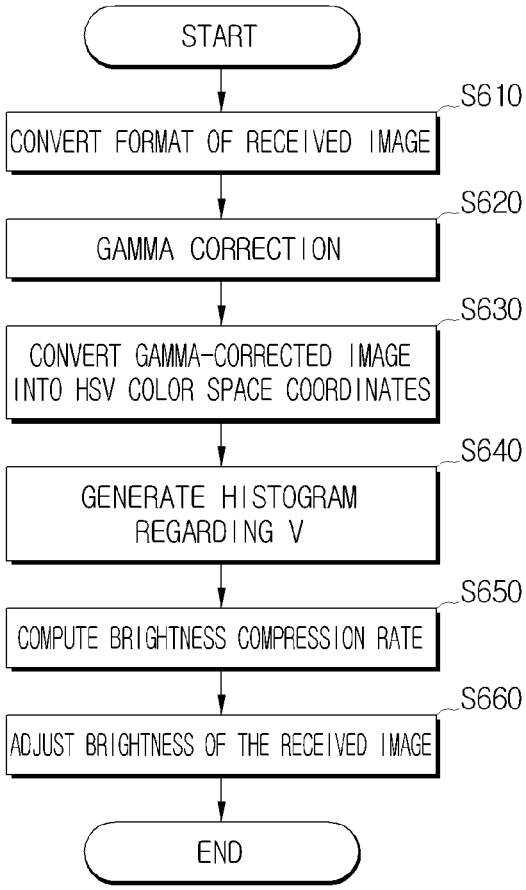
FIG. 6 is a flowchart to explain a method of operating a display device according to an exemplary embodiment of the present invention.

FIG. 6 is a flowchart to explain a method of operating a display device according to an exemplary embodiment of the present invention.

In operation S610, the format converting unit 110 converts the format of received image. Specifically, the format converting unit 110 converts a received xvYCC image into an RGB image. The format converting unit 110 may also receive a YCbCr image and convert it into an RGB image, in addition to the images with extended color gamut such as xvYCC or sYCC.

In operation S620, the first gamma correction unit 120 performs gamma correction based on the characteristics of the converted RGB image. Accordingly, the gamma correction unit 120 receives non-linear RGB data to gamma-correct and output linear RGB data.

In operation S630, the color space converting unit 141 converts the gamma-corrected RGB image so that a corresponding image appears on the HSV color space.

In operation S640, the histogram generating unit 143 generates histograms for each of the R, G and B color regions, based on the V of the image appearing on the HSV color space, and generates reverse-accumulative histograms of each of the R, G and B color regions based on the generated histograms.

Specifically, the histogram generating unit 143 generates a histogram based on the accumulated number of the pixels that correspond to the V of the image converted to be located on the HSV color space. The histogram generating unit 143 generates histograms of the R, G and B regions defined by the hue (H), based on the accumulated number of the pixels that correspond to the same V of each of the R, G and B regions. The histogram generating unit 143 generates a reverse-accumulative histogram of each of the R, G and B color regions, by accumulating the number of the pixels that correspond to the V ranging from 512 to 0, or from 0 to 512, among the entire pixels distributed in each of the R, G and B color regions.

In operation S650, the computing unit 145 computes a brightness compression rate of each of the color regions, by dividing the maximum value of the displayable color gamut by a reference brightness of each color region, based on the generated reverse-accumulative histogram.

Specifically, in order to compute the brightness compression rate of the R region, the computing unit 145 divides 255, the maximum brightness displayable, by the reference brightness of the R region, i.e., 255/300=0.85. While 255 is explained as the maximum displayable brightness in consideration of the fact that the displayable brightness ranges from 0 to 255, one will understand that brightness exceeding 255 may also be set to be the maximum brightness if the brightness more than 255 is displayable.

In operation S660, the brightness adjusting unit 147 adjusts the brightness of the image by multiplying the computed brightness compression rate of each of the color region by the brightness of each color region.

Accordingly, the brightness adjusting unit 147 adjusts the brightness of the pixels distributed in each color region. If each color region includes a V that exceeds the reference, the brightness adjusting unit 147 adjusts the V by clipping. The reference brightness represents the V that corresponds to the reference pixel value, and the reference pixel value represents the number of the pixels that correspond to the preset reference among the entire pixels distributed in each color region.

In the above description of a display apparatus and an image enhancement method thereof according to the exemplary embodiments of the present invention, the histogram generating unit 143 has been explained as generating a histogram of a R region based on the accumulation of the pixels that have the same V. However, this should not be understood as limiting. A histogram of the R region may be generated based on the accumulation of the pixels that have the V falling to a predetermined range.

According to an aspect of the present invention, the brightness adjusting unit 147 may apply different weights for each of the H regions, based on the brightness compression rates of the H regions computed at the computing unit 145. The brightness adjusting unit 147 may adjust the weights according to the distribution of the image pixels in each of the color regions.

The brightness adjusting unit 147 may adjust the brightness of the image based on H regions (s1 to s3), by multiplying a preset weight by each of the H regions (s1 to s3).

Figure 5:
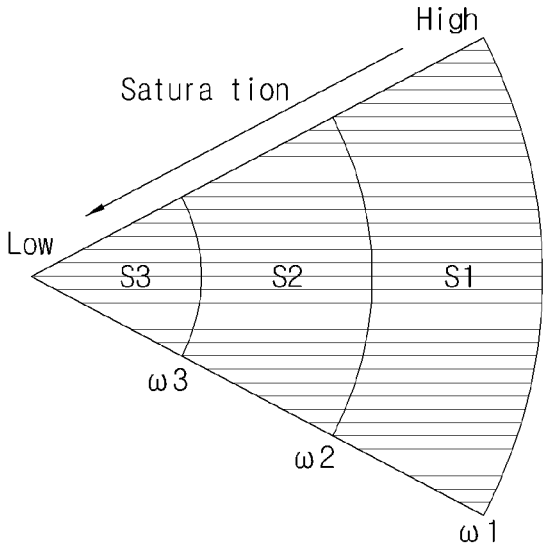
FIG. 5 illustrates the weights given according to saturation in the HSV color space coordinate system of FIG. 3.

Referring to FIGS. 3 and 5, in order to enhance details of the pixels of higher hue in R region, the brightness adjusting unit 147, for example, may set weight w1 of the first H region s1 to be 0.5, weight w2 of the second H region s2 to be 0.3, and weight w3 of the third H region s3 to be 0.2. The brightness adjusting unit 147 may then enhance the details of the pixels of high hue, among the pixels of the R region of the image, by multiplying the set weights by the H regions.

The details and color purity of the image can further be enhanced by increasing the weight of the brightness compression, if color space distribution of the image is greater than the maximum brightness displayable by the display unit 160 of each of the H regions.

In the above description of a display apparatus and an image enhancement method thereof according to the exemplary embodiments of the present invention, the computing unit 145 has been explained as computing a brightness compression rate. However, the brightness compression rate may alternatively be implemented to represent the brightness change rate of the image.

Further, while an image has been explained as being located on the HSV color space coordinates, the image may alternatively be located on the absolute or relative color space coordinates such as Yuv, or YCbCr color space.

Further, while the display apparatus has been explained so far, one will understand the image enhancement according to the exemplary embodiments of the present invention is applicable to broadcast receiving devices or image devices. That is, the image devices such as a digital video disk (DVD) player, a personal computer (PC) monitor, a projector, a digital camera, or a digital camcorder, or the broadcasting receiving devices such as set top boxes (STB), digital televisions or home theaters may be implemented.

According to the exemplary embodiments of the present invention, the image quality of a received image signal is improved by the color space conversion of the image signal and change of the brightness of the image signal based on the color information acquired from the image signal.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A method of image enhancement, the method comprising:

acquiring, by a display apparatus, color information from a color region of an image converted from an original image; and changing, by the display apparatus, a brightness of the original image wherein the changing the brightness comprises changing the brightness of the original image based on a brightness compression rate, the brightness compression rate being a rate between a color value from a color distribution based on the color information and a displayable color value of the display apparatus.

2. The method of claim 1, wherein the changing the brightness comprises converting a number of pixels regarding the color information into a histogram and determining the color distribution based on the histogram.

3. The method of claim 1, wherein the changing the brightness comprises determining a brightness compression rate of the original image according to chromaticity, and changing the brightness of the original image based on the brightness compression rate.

4. The method of claim 1, wherein the acquiring the color information comprises acquiring the color information by performing a color space conversion of the original image, and the changing the brightness comprises generating a reverse-accumulative histogram based on the color information and changing the brightness of the original image based on the color distribution determined through the reverse-accumulative histogram.

5. The method of claim 4, wherein the color space conversion comprises converting the color space of the original image into one of a YCbCr space, a red green blue (RGB) space, CIE xy color space, a CIE Luv color space, and a Hue Saturation Value (HSV) color space.

6. The method of claim 4, wherein the changing the brightness comprises changing the brightness of the original image with respect to each of color regions constituting the converted color space.

7. The method of claim 6, wherein the changing comprises changing the brightness of the original image based on a total number of pixels of the color regions and a preset reference.

8. The method of claim 6, wherein the changing the brightness comprises converting a plurality of pixels of each of the color regions into a histogram, and converting the histogram into a reverse-accumulative histogram to determine the color distribution of the converted image, and the changing the brightness comprises changing the brightness of the original image for each of the color regions, based on the color distribution.

9. The method of claim 6, wherein the changing the brightness comprises:

determining a number of pixels that correspond to a reference among all pixels included in the color regions;

searching a color value that corresponds to the number of pixels, based on the color distribution of the converted image; and determining a brightness compression rate to change the brightness of the original image, the brightness compression rate being a rate between the searched color value and a maximum displayable color value.

10. The method of claim 9, wherein the changing the brightness comprises changing the brightness of the original image by multiplying the brightness compression rate by each of the pixels included in the color regions.

11. The method of claim 1, wherein the color information comprises at least one of a hue, a saturation, and a value of the converted image.

12. The method of claim 1, wherein the converted image has an extended region from a displayable brightness region of the display apparatus.

13. A display apparatus comprising:

a computing unit which acquires color information from a color region of an image converted from an original image, and determines a brightness changing rate, the brightness changing rate being a rate between a reference brightness value from a color distribution based on the color information and displayable color gamut of the display apparatus; and a brightness adjusting unit which adjusts a brightness of the original image based on the brightness changing rate determined by the computing unit.

14. The display apparatus of claim 13, wherein the computing unit converts a plurality of pixels regarding the color information into a histogram and determines the brightness changing rate based on the histogram.

15. The display apparatus of claim 13, wherein the computing unit determines the brightness changing rate according to a chromaticity, and the brightness adjusting unit adjusts the brightness of the original image based on the brightness changing rate determined by the computing unit.

16. The display apparatus of claim 13, wherein the computing unit acquires the color information by performing a color space conversion of the original image, and the brightness adjusting unit changes the brightness of the original image based on the brightness changing rate determined by the computing unit.

17. The display apparatus of claim 16, wherein the color space conversion comprises converting the color space of the original image into one of a YCbCr space, a red green blue (RGB) space, a CIE xy color space, a CIE Luv color space, and a Hue Saturation Value (HSV) color space.

18. The display apparatus of claim 16, wherein the computing unit determines the brightness changing rate of each of color regions defined by a hue in the color space, and the brightness adjusting unit adjusts the brightness of each of the color regions of the original image, by applying the brightness changing rates to each of the color regions.

19. The display apparatus of claim 18, wherein the computing unit computes a reference pixel value based on a total number of pixels included in each of the color regions of the converted color space, and the brightness changing rate to represent a relation between a reference brightness value that corresponds to the reference pixel value and a maximum displayable color gamut, and the brightness adjusting unit adjusts the brightness of the original image by multiplying the brightness value of the image distributed in each of the color regions by the brightness changing rate of each of the color regions.

20. The display apparatus of claim 13, wherein the converted image has an extended region from a displayable brightness region of the display apparatus.

21. A method of image enhancement, the method comprising:

acquiring, by a display apparatus, color information from a color region of an image converted from an original image; and changing, by the display apparatus, the brightness of the original image only, wherein the changing the brightness comprises changing the brightness of the original image based on a brightness changing rate, the brightness changing rate being a rate between a reference brightness value from a color distribution based on the color information and displayable color gamut of the display apparatus.

22. The method of claim 21, wherein the acquiring the color information comprises acquiring the color information by performing a color space conversion of the original image, and the determining the brightness changing rate comprises converting a plurality of pixels of the color information into a histogram and determining the brightness changing rate based on the histogram.

23. The method of claim 21, wherein the changing the brightness rate comprises determining the brightness changing rate of each of color regions defined by chromaticity, and the changing the brightness comprises changing the brightness of each of the color regions of the original image based on the brightness changing rate of each of the color regions.

24. The method of claim 21, wherein the changing the brightness rate comprises determining the brightness changing rate of each of the color regions based on a total number of pixels included in each of the color regions of the converted color space, and the brightness changing rate to represent a relation between a reference brightness value that corresponds to the reference pixel value and a maximum displayable color gamut, and the changing the brightness comprises changing the brightness of each of the color regions of the original image by multiplying the brightness value of the image distributed in each of the color regions by the brightness changing rate of each of the color regions.

25. The method of claim 22, wherein the color space conversion comprises converting the color space of the original image into one of a YCbCr space, a red green blue (RGB) space, a CIE xy color space, a CIE Luv color space, and a Hue Saturation Value (HSV) color space.

* * * * *